US007624803B2

(12) United States Patent
Daccord et al.

(10) Patent No.: US 7,624,803 B2
(45) Date of Patent: Dec. 1, 2009

(54) INJECTION APPARATUS FOR INJECTING AN ACTIVATED FLUID INTO A WELL-BORE AND RELATED INJECTION METHOD

(75) Inventors: Gérard Daccord, Vauhallan (FR); Christophe Rayssiguier, Melun (FR); Bernard Dargaud, Elancourt (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/576,708

(22) PCT Filed: Oct. 10, 2005

(86) PCT No.: PCT/EP2005/011000

§ 371 (c)(1),
(2), (4) Date: Dec. 13, 2007

(87) PCT Pub. No.: WO2006/040147

PCT Pub. Date: Apr. 20, 2006

(65) Prior Publication Data

US 2008/0093077 A1 Apr. 24, 2008

(30) Foreign Application Priority Data

Oct. 12, 2004 (EP) ..... 04292412

(51) Int. Cl.
*E21B 33/00* (2006.01)
*E21B 43/26* (2006.01)
*E21B 37/10* (2006.01)

(52) U.S. Cl. ..... 166/305.1; 166/153; 166/310; 166/326; 166/68

(58) Field of Classification Search ..... 166/305.1, 166/153, 310, 34, 902, 333.1, 166, 165, 169, 166/286, 291, 177.4, 177.7, 326, 68, 105, 166/107, 108, 162, 318, 319, 320; 222/643, 222/410, 412, 478
See application file for complete search history.

(56) References Cited

U.S. PATENT DOCUMENTS

| | | | | |
|---|---|---|---|---|
| 2,769,498 | A * | 11/1956 | Huber | 166/66.4 |
| 3,273,647 | A | 9/1966 | Briggs, Jr. et al | |
| 4,064,941 | A * | 12/1977 | Smith | 166/300 |
| 4,361,187 | A * | 11/1982 | Luers | 166/326 |
| 4,384,615 | A * | 5/1983 | Luers | 166/326 |
| 4,415,269 | A | 11/1983 | Fraser | |
| 5,533,570 | A | 7/1996 | Streich et al. | |
| 5,544,705 | A * | 8/1996 | Jones et al. | 166/250.04 |
| 5,582,251 | A * | 12/1996 | Bailey et al. | 166/286 |
| 5,718,287 | A | 2/1998 | Streich et al. | |

FOREIGN PATENT DOCUMENTS

EP 1223303 A1 7/2002

* cited by examiner

*Primary Examiner*—Jennifer H Gay
*Assistant Examiner*—Yong-Suk Ro
(74) *Attorney, Agent, or Firm*—David Cate; Robin Nava; Dale Gaudier

(57) ABSTRACT

An injection apparatus for injecting an activated fluid and an activated chemical fluid mixture into a well-bore is disclosed. Then, an injection method for injecting an activated fluid into a well-bore is also disclosed. A particular application to the oilfield industry, for example in cementing operation is encompassed. The apparatus and the method of use is fully automatic.

14 Claims, 9 Drawing Sheets

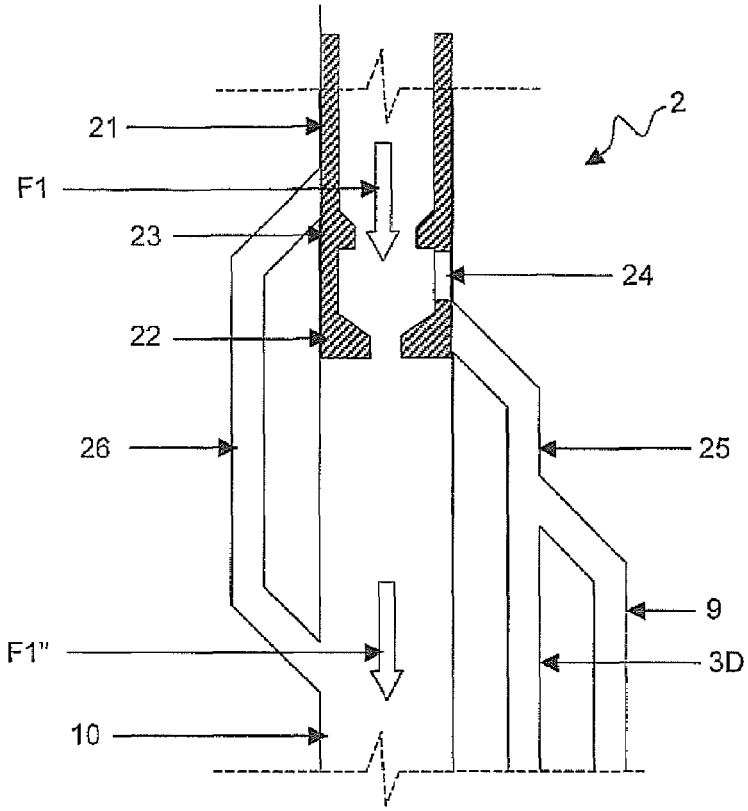
Figure 3.A
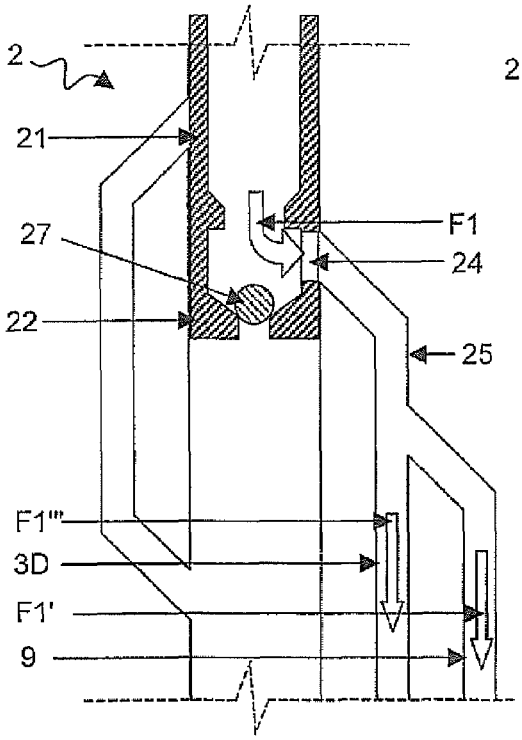
Figure 3.B
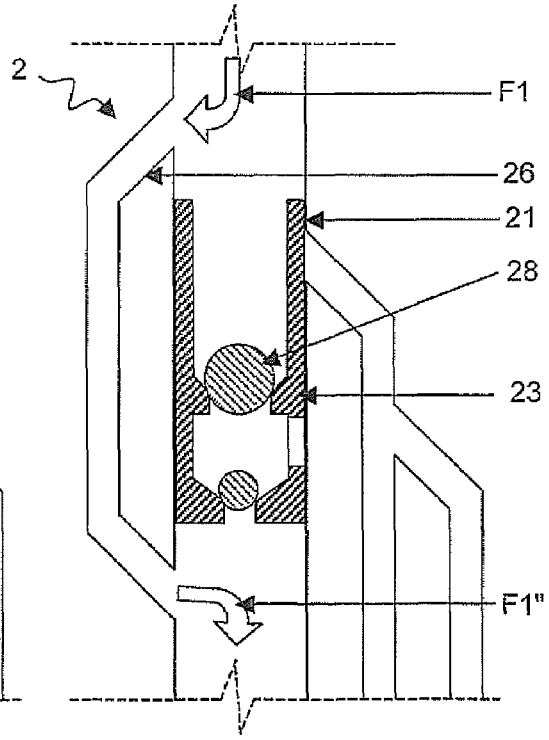
Figure 3.C

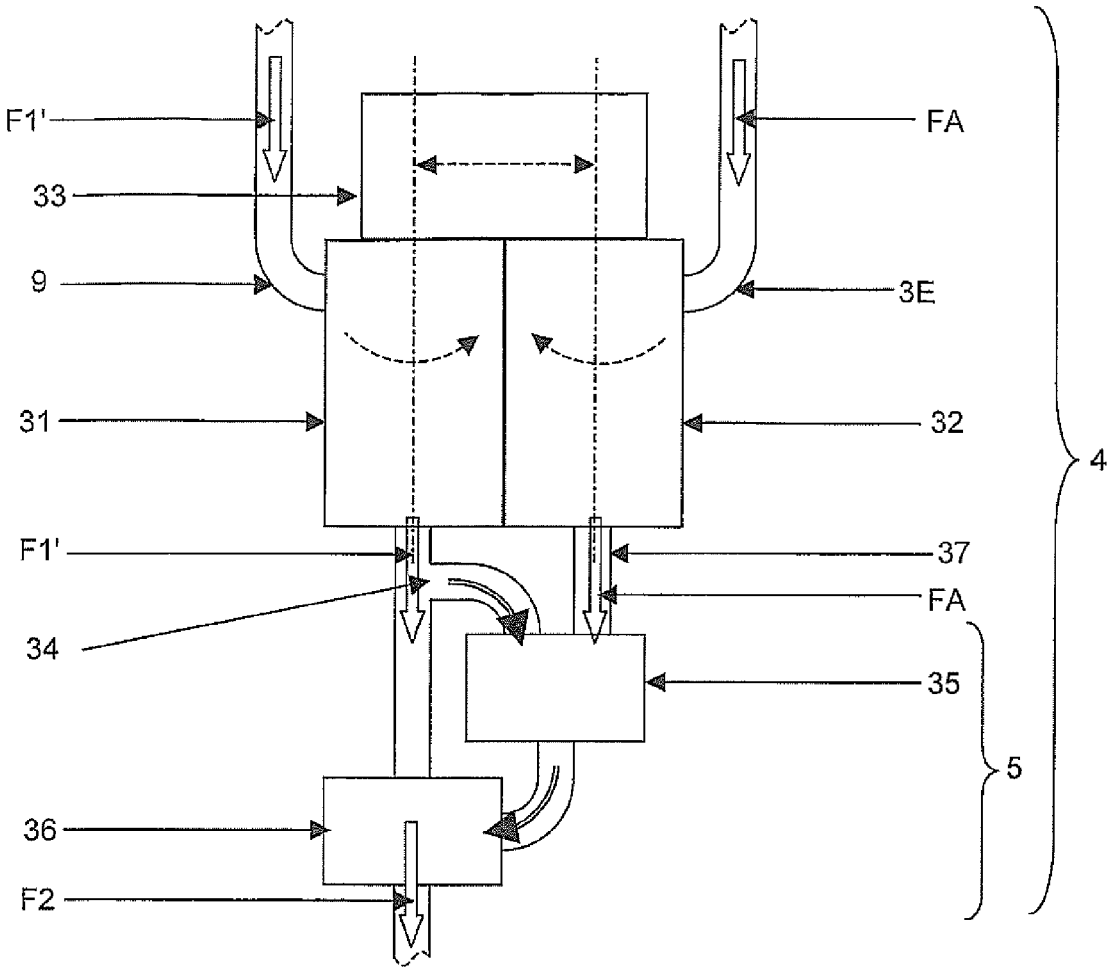
Figure 4.A

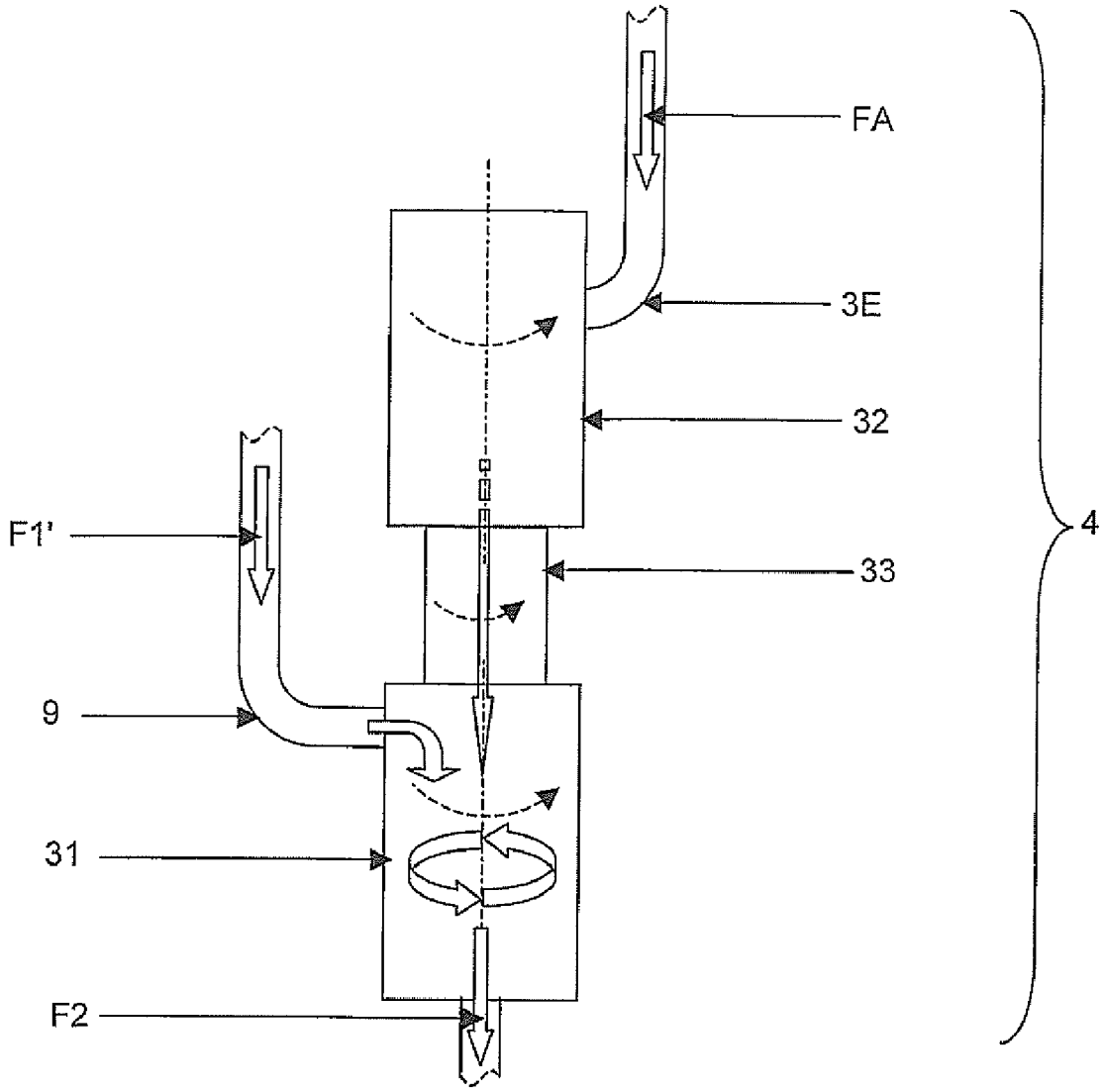
Figure 4.B

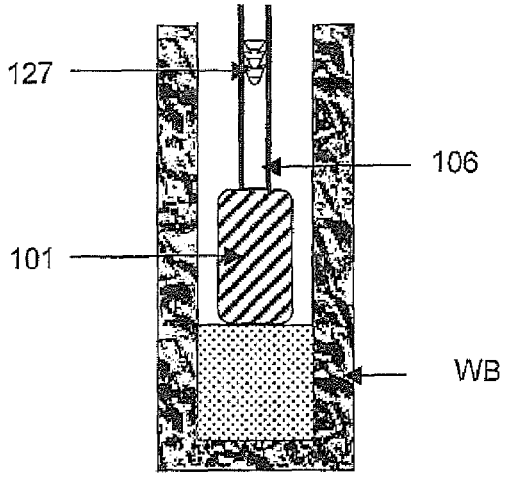
Figure 5.A
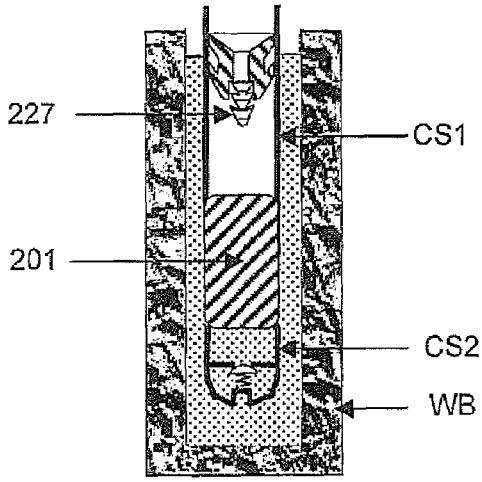
Figure 6.A
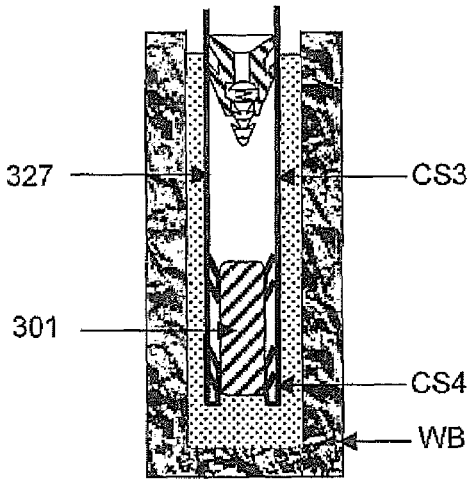
Figure 7.A

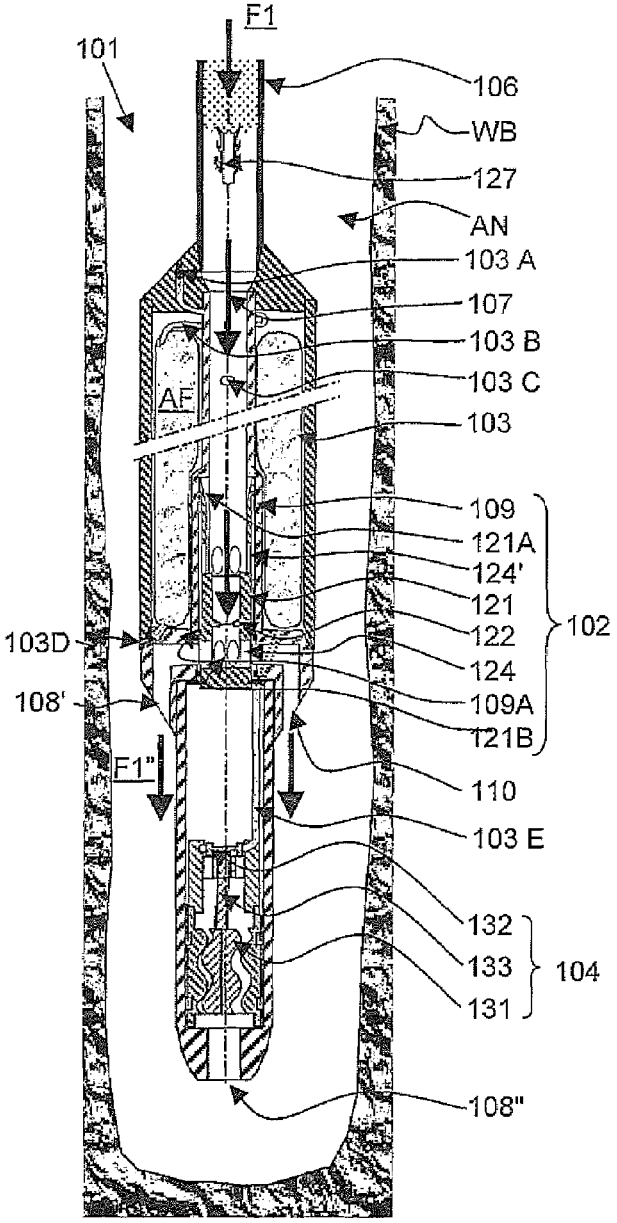
Figure 5.B
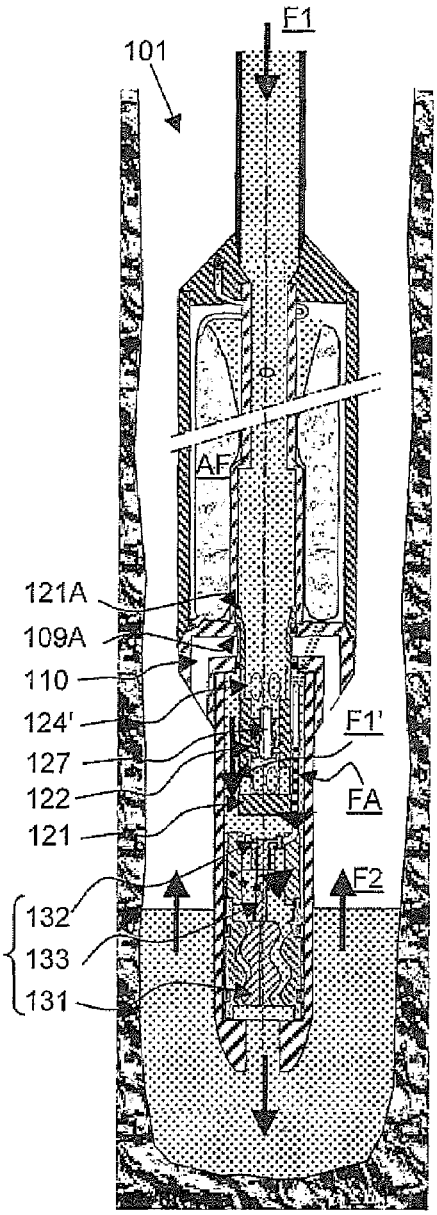
Figure 5.C

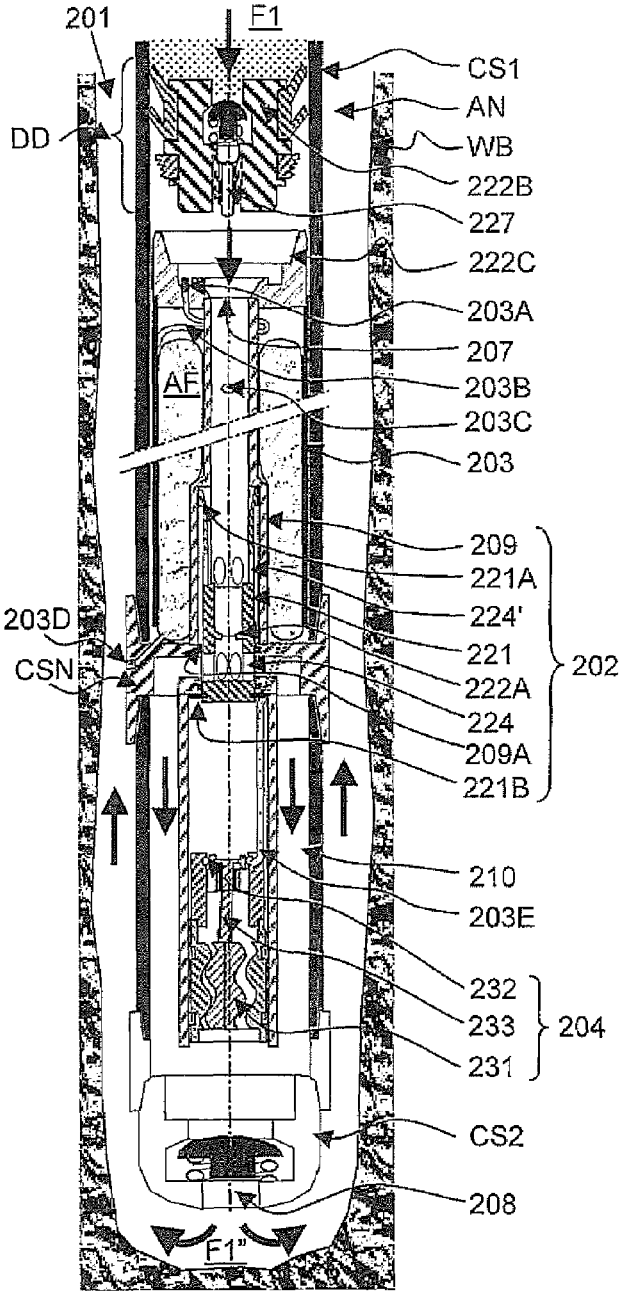
Figure 6.B
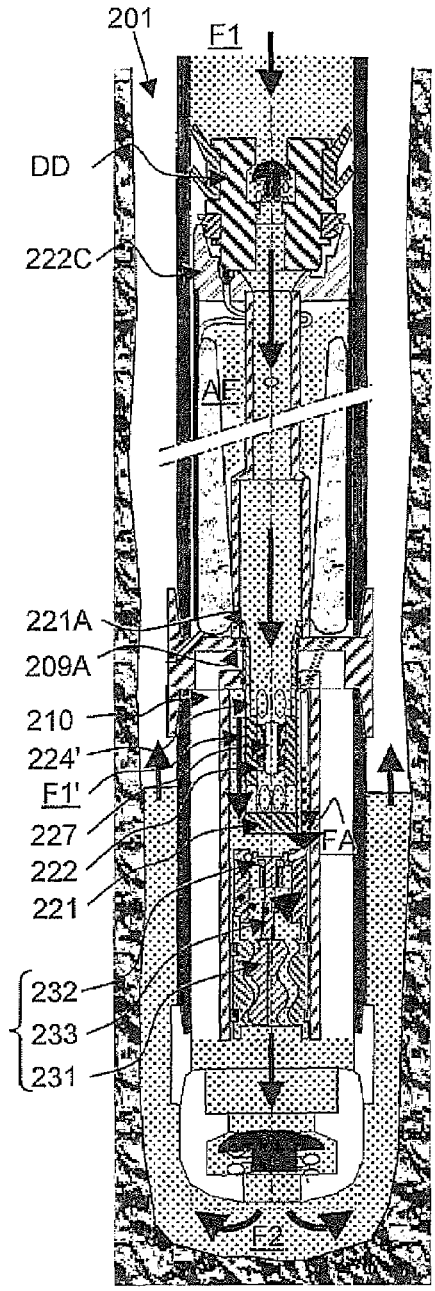
Figure 6.C

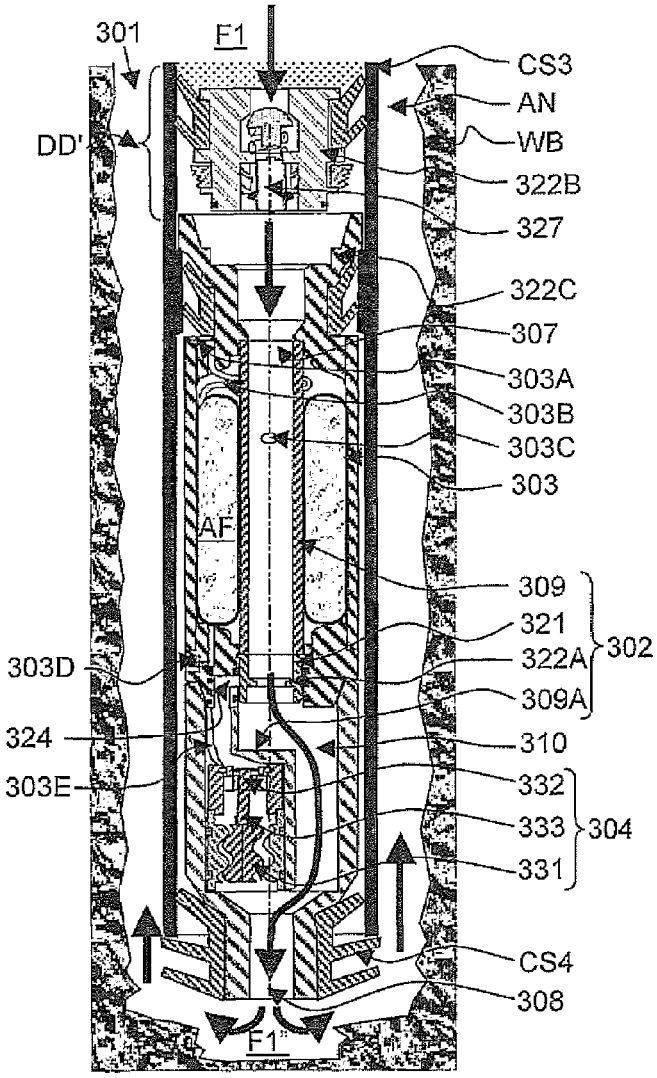
Figure 7.B
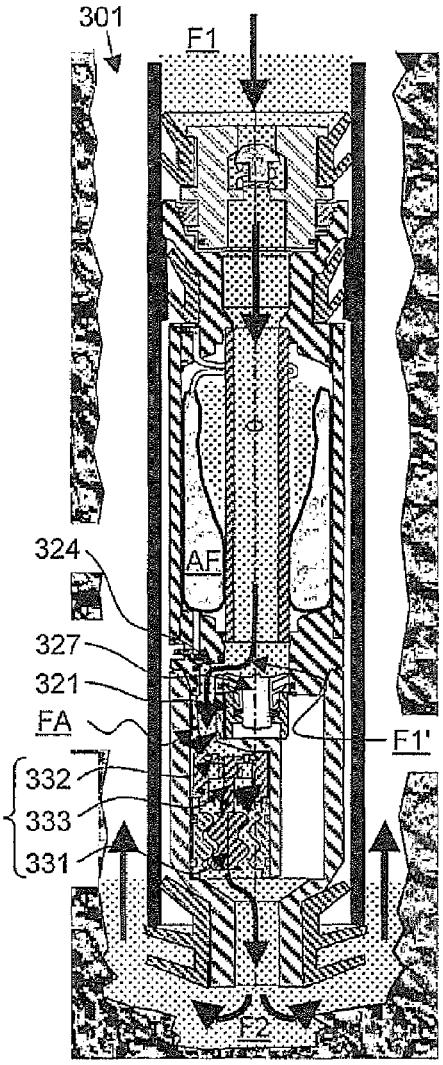
Figure 7.C

INJECTION APPARATUS FOR INJECTING AN ACTIVATED FLUID INTO A WELL-BORE AND RELATED INJECTION METHOD

FIELD OF THE INVENTION

The invention relates to an injection apparatus for injecting an activated fluid (e.g. an activated chemical fluid mixture) into a well-bore. The invention also relates to an injection method for injecting an activated fluid into a well-bore.

A particular application of the invention relates to the oil-field industry, for example in cementing operation.

BACKGROUND OF THE INVENTION

During a hydrocarbon well drilling operation and after a hydrocarbon well has been drilled, various fluid injecting operations are generally carried out. The fluid injecting operations serves various purposes, for example delivering a chemical mixture into a fluid present in the borehole for consolidation purpose or fracturing purpose, or delivering a chemical mixture into a cement slurry for borehole cementing operation. These operations are well known in the oilfield industry and are described for example in U.S. Pat. No. 3,273,647, U.S. Pat. No. 4,415,269 and patent application EP 1223303. FIG. 1 schematically shows a typical onshore hydrocarbon well location and equipments WE above a hydrocarbon geological formation GF after drilling operation has been carried out and after a casing string CS has been run. At this stage, the well-bore WB is a bore-hole generally filled with various fluid mixtures (e.g. the drilling mud or the like). The equipment WE comprises a drilling rig DR for running the casing string CS in the bore-hole, cementing equipment comprising cement silo CR and pumping arrangement CP, and a well head and stuffing box arrangement WH providing a sealing for deploying the casing string CS or pumping down the cement into the generally pressurized well-bore WB.

Subsequently, cementing operations are generally undertaken to seal the annulus AN (i.e. the space between the well-bore WB and the casing CS where fluid can flow). A first application is primary cementing which purpose is to achieve hydraulic isolation around the casing. Other applications are remedial cementing which purposes are to stabilize the well-bore, to seal a lost circulation zone, to set a plug in an existing well or to plug a well so that it may be abandoned. The cement may be pumped into the well casing through a casing shoe CI near the bottom of the bore-hole or a cementing valve installed in the casing so that the cement is positioned in the desired zone.

Cementing engineers prepare the cementing operations by determining the volume and physical properties of cement slurry and other fluids pumped before and after the cement slurry. In many situations, chemical additives are mixed with the cement slurry in order to modify the characteristics of the slurry or set cement. Cement additives may be broadly categorized as accelerators (i.e. for reducing the time required for the set cement to develop sufficient compressive strength to enable further operations to be carried out), retarders (i.e. for increasing the thickening time of cement slurries to enable proper placement), dispersants (i.e. for reducing the cement slurry viscosity to improve fluid-flow characteristics), extenders (i.e. for decreasing the density or increasing the yield of a cement slurry), weighting agents (i.e. for increasing or lightening the slurry weight), fluid-loss or lost-circulation additives (i.e. for controlling the loss of fluid to the formation through filtration) and special additives designed for specific operating conditions.

Because cement additives have an effect as soon as they are mixed with the cement slurry, it is important that cement additives are injected in the cement slurry at the proper time and at the desired location in the well-bore.

Apparatus for injecting cement additives are known. For example, U.S. Pat. No. 5,533,570 discloses an apparatus for injecting a fluid into a well-bore. This apparatus comprises a fluid holding chamber that is pumped down the well-bore, and a valve means for opening a port of the chamber and delivering the fluid at a desired time and location (for example through an opening of the casing shoe). However, this apparatus does not include an efficient additive dosing system. Further, the apparatus is non-retrievable.

SUMMARY OF THE INVENTION

One goal of the invention is to propose an apparatus for injecting an activated chemical fluid mixture into a well-bore that overcome at least one of the shortcomings of prior art apparatus.

According to the invention, the apparatus for injecting an activated chemical fluid mixture into a well-bore comprises a valve arrangement, an activation fluid reservoir and a dosing and mixing arrangement coupled to each other. The valve arrangement can be remotely activated from the surface. The apparatus is coupled to a standard drill-pipe string or a casing string in order to receive a flow of a first fluid and activation commands for the valve arrangement. The valve arrangement activates and controls the dosing and mixing arrangement so as to inject a determined quantity of activation fluid into the first fluid. The apparatus can be coupled to any casing, cementing or drilling equipments, and provides to these equipments a flow of a second fluid that may be constituted of an activated chemical fluid mixture.

More precisely, the present invention relates to an injection apparatus for injecting an activated fluid into a well-bore comprising a reservoir containing an activation fluid AF. The injection apparatus further comprises:

- a valve arrangement adapted to be coupled to a pipe (drill-stem or casing string) for receiving a first fluid flow,
- a dosing and mixing arrangement coupled to the reservoir and to the valve arrangement.

The valve arrangement has a rest configuration in which the injection apparatus provides a non-activated fluid mixture and an activated configuration in which the injection apparatus provides an activated fluid mixture.

The dosing and mixing arrangement comprises an engine part mechanically coupled to a pumping part. The engine part runs the pumping part and the pumping part sucks the activation fluid of the reservoir when the valve arrangement is in the activated configuration. The dosing and mixing arrangement mixes the activation fluid with the first fluid and provides an activated fluid mixture flow at an outlet.

Advantageously, the injection apparatus further comprises a pressure adjusting arrangement for adjusting the pressure inside the reservoir to the pressure inside the pipe (a reservoir comprising a piston or a reservoir comprising an equalization port).

Advantageously, the valve arrangement comprises a sliding sleeve having a first dart catcher for remotely activating the valve arrangement from the rest configuration to the activated configuration.

Other characteristics of the injection apparatus will be further described in the detailed description herein below.

The apparatus for injecting an activated chemical fluid mixture into a well-bore of the invention is adapted to be connected to a drill-string or a casing string. The apparatus is fully retrievable: it can be removed from the well-bore when operations are completed and re-used for subsequent operations. Alternatively, it can be drilled if rig-time needs to be saved. It enables a truly proportional dosing of an activation fluid into a fluid to be activated. Finally, it can be remotely controlled.

Consequently, the apparatus of the invention is flexible, cheap and efficient to use in various oilfield industry oriented applications.

In particular, the apparatus can be used in casing stab-in situation (i.e. injecting a chemical activator into a cement slurry directly at the casing shoe), in drilling situation (i.e. injecting a chemical activator into a reactive fluid pumped through the drill-string) for well-bore walls or plugs voids consolidation, in cement plug situation (i.e. injecting a chemical activator into a fluid for temporary of permanent sealing inside the well-bore), in casing-drilling situation, or in coiled-tubing operation (i.e. injecting a chemical activator into the main fluid for coiled tubing fracturing or remedial cementing).

The invention also relates to an injection method for injecting an activated fluid into a well-bore. The method comprises the steps of:

- running the injection apparatus of the invention at a proper location in the well-bore, the valve arrangement being in a rest configuration,
- letting flow a first fluid through the apparatus into the well-bore,
- activating the valve arrangement of the injection apparatus in an activated configuration in which a first portion of the first fluid activates a pumping part sucking the activation fluid of the reservoir,
- mixing the sucked activation fluid with the first portion of the first fluid, and
- injecting an activated fluid mixture flow at an outlet.

Optionally, the method further comprises the steps of activating the valve arrangement of the injection apparatus in a by-pass position in which a second portion of the first fluid flows directly to the outlet (non activated fluid flow).

Advantageously, the activating steps are remotely controlled from a surface equipment.

Thus, the invention provides an efficient apparatus and method which can be run at a desired location in a well-bore and remotely activated at a particular moment for injecting an additive contained in a reservoir into the well-bore.

BRIEF DESCRIPTION OF THE DRAWINGS

The present invention is illustrated by way of example and not limited to the accompanying figures, in which like references indicate similar elements:

FIGS. 3.A, 3.B and 3.C schematically illustrate the valve arrangement of the apparatus of FIG. 2 and its various positions during operation;

FIG. 4.A schematically illustrates a first embodiment of the dosing and mixing arrangement of the apparatus of FIG. 2;

FIG. 4.B schematically illustrates a second embodiment of the dosing and mixing arrangement of the apparatus of FIG. 2;

FIG. 5.A schematically illustrates a first application of the invention;

FIGS. 5.B and 5.C are detailed cross-section views of the first application of FIG. 5.A;

FIG. 6.A schematically illustrates a second application of the invention;

FIGS. 6.B and 6.C are detailed cross-section views of the second application of FIG. 6.A;

FIG. 7.A schematically illustrates a third application of the invention; and FIGS. 7.B and 7.C are detailed cross-section views of the third application of FIG. 7.A.

DETAILED DESCRIPTION OF THE INVENTION

Figure 1:
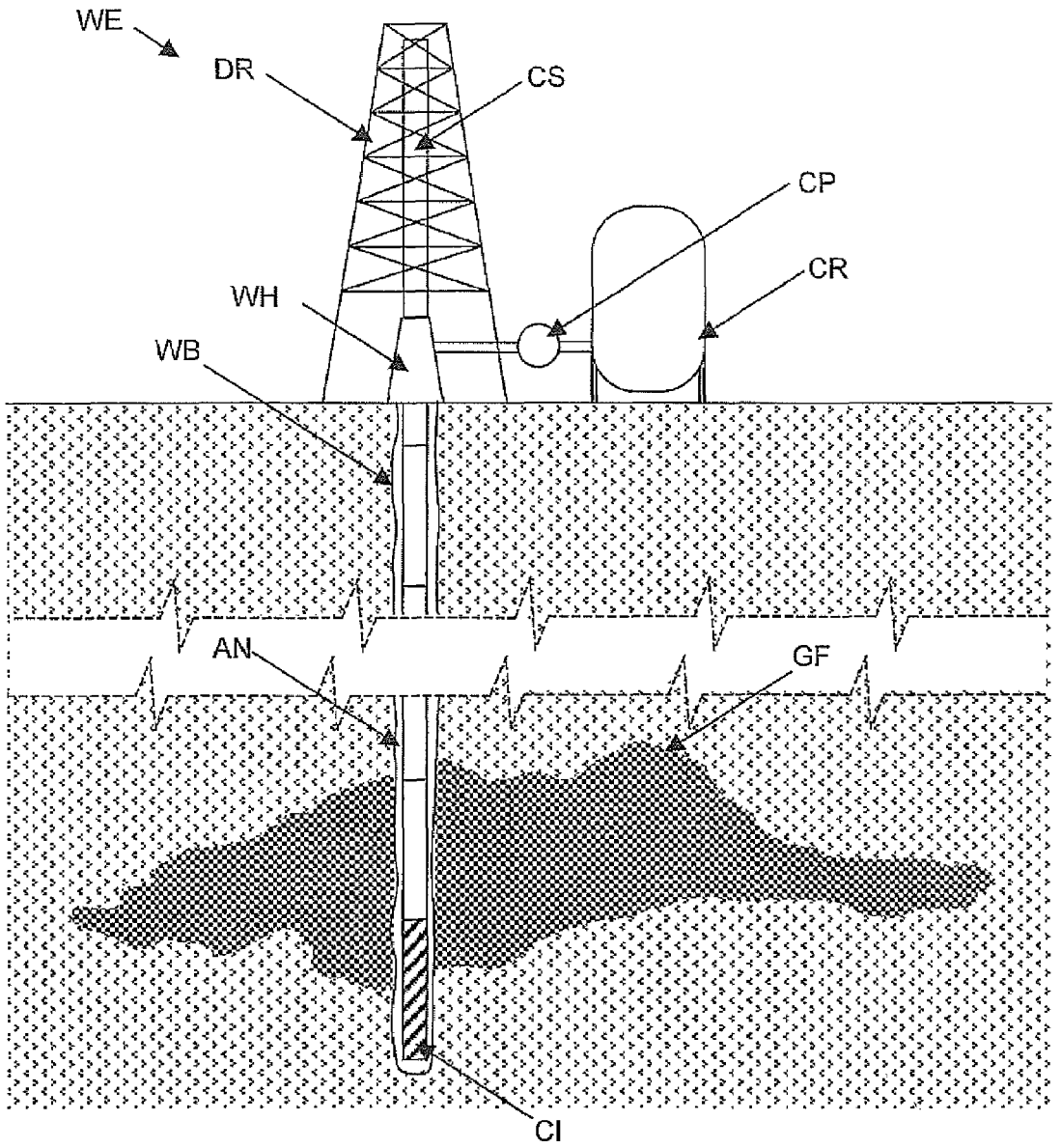
FIG. 1 schematically shows a typical onshore hydrocarbon well location and equipments.

FIG. 1 was already described in relation with the background of the invention.

Figure 2:
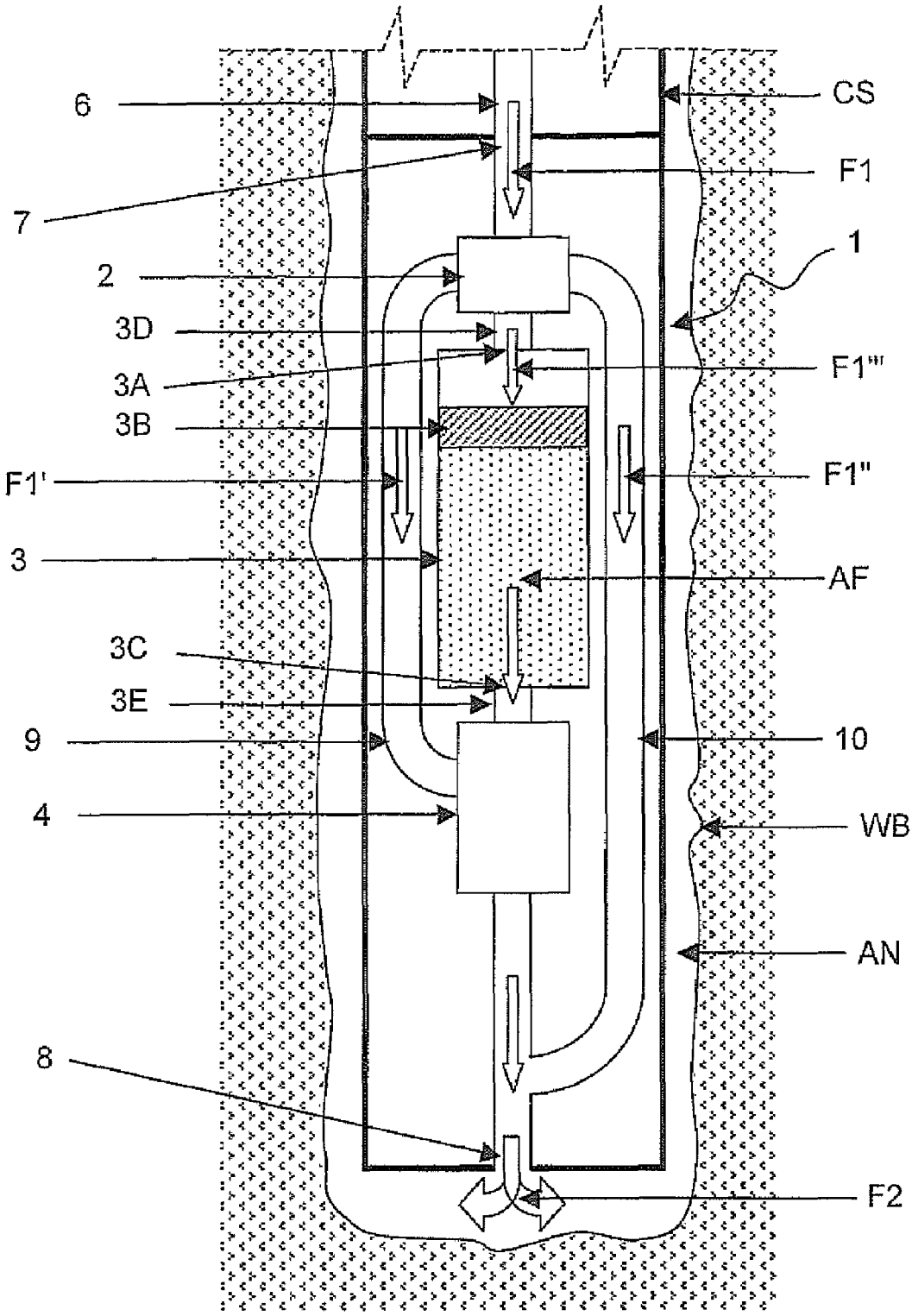
FIG. 2 schematically illustrates an apparatus for injecting a chemical fluid mixture into a well-bore according to the invention.

FIG. 2 schematically illustrates an apparatus 1 for injecting an activated chemical fluid mixture into a well-bore.

The apparatus 1 for injecting a chemical fluid mixture is fitted into the casing CS. The apparatus is coupled by its upper part to a standard drill-pipe string 6. The apparatus is coupled by its lower part to any equipment such as a standard float equipment of a stab-in casing, a casing drilling or casing shoe, or left as such for other drilling or cementing applications. The apparatus receives through an inlet 7 a flow of a first fluid F1 from the drill-pipe string 6 and provides through an outlet 8 a flow of a second fluid F2.

The apparatus 1 for injecting a chemical fluid mixture comprises a valve arrangement 2, a reservoir 3, a dosing and mixing arrangement 4 and shunt tubes 9, 10.

The valve arrangement 2 is coupled to the drill-pipe string 6 or directly to a casing element of the casing string and receives the flow of the first fluid F1. The valve arrangement is also coupled to the reservoir 3 through a first reservoir conduit 3D and to the dosing and mixing arrangement 4 through a first shunt tube 9. The valve arrangement may also be coupled directly after the mixing arrangement 5 through a second shunt tube 10. The valve arrangement can be remotely activated (i.e. opening or closing of valves and ports) from the surface. Depending on the configuration of the valve arrangement 2, the fluid F1 may be divided into a first portion F1' flowing through the shunt tube 9, or a second portion F1" flowing through the second shunt tube 10 and a third portion F1'" flowing though the reservoir conduit 3D.

The reservoir 3 contains an activation fluid AF. The activation fluid may be pressurized by means of a piston 3B when submitted to the pressure of the third flow portion F1'" flowing through the conduit 3D to an upper port 3A into an upper part of the reservoir. The activation fluid AF may flow through a lower port 3C and a second reservoir conduit 3E into the dosing and mixing arrangement 4. The piston 3B also acts as a mechanical plug separating the activation fluid AF from the third fluid portion F1'". The reservoir has for example a cylindrical shape and the piston is a plug similar to the standard plugs used in primary cementing. The reservoir volume (diameter, length) can be very easily adapted to each situation of use of the apparatus, namely quantity of activation fluid to be injected or available place within the casing string, etc. . . .

Alternatively, the conduit 3D, the upper port 3A and the piston 3B may be replaced by an equalization port for automatically adjusting the pressure inside the reservoir 3 to the pressure inside the drill-pipe or the casing string. In this case, the reservoir may be a rubber bladder. The bladder membrane submitted to the tubing pressure through the equalization port plays the role of the piston relatively to the activation fluid.

The dosing and mixing arrangement 4 is coupled to the first shunt tube 9. It is also coupled to the lower port 3C of the reservoir by the conduit 3E and may receive a portion of the activation fluid AF contained in the reservoir. The dosing and mixing arrangement determines the ratio of activation fluid AF injected into the first fluid flow F1 (in fact into the first portion F1' of the first fluid flow).

The dosing and mixing arrangement 4 provides the second fluid flow F2 to the outlet 8. It insures a proper mixing of the injected activation fluid AF with the first portion F1' of the first fluid flow.

Alternatively, a complementary mixing arrangement may be coupled downstream to the dosing and mixing arrangement.

The second shunt tube 10 couples the valve arrangement directly to the outlet 8. It acts as a side conduit for providing, at the outlet 8, a second portion F1" of the first fluid flow that does not need to be activated by the activation fluid. In this case, the second fluid F2 flowing through the outlet 8 is chemically identical to the first fluid F1 flowing through the inlet 7.

The first and second shunt tubes 9, 10 are conduits by-passing the reservoir 3 and attached to its periphery. The shunt tubes can be designed with various diameters and lengths adapted to the various specific use of the apparatus.

The operation principle of the apparatus 1 for injecting an activated fluid mixture into a well-bore will be explained herein below in relation with FIGS. 3 and 4.

FIGS. 3.A, 3.B and 3.C schematically illustrate the valve arrangement 2 and its various positions during operation.

The valve arrangement 2 comprises a sliding sleeve 21. The sliding sleeve 21 is hollow so as to let flow the first fluid F1. It also comprises a side opening 24 for letting flow a portion of the first fluid F1. The sliding sleeve comprises a first dart catcher 22 and optionally a second dart catcher 23. The dart catcher can be remotely activated by a dart sent from the surface in the first fluid F1 through the drill-pipe string 6 or the casing string CS. This activation of the dart catcher determines different operating configuration or position of the valve arrangement.

The valve arrangement 2 comprises a first side conduit 25 connected to the first reservoir conduit 3D and the first shunt tube 9, and optionally a second side conduit 26.

According to another embodiment, the second shunt tube is omitted. This embodiment is advantageous when the apparatus does not need to be fastened to a casing shoe.

FIG. 3.A shows the valve arrangement 2 in a first configuration (rest configuration) before activation of the first dart catcher 22 by a first dart. In this configuration, the sliding sleeve closes the first 25 and second 26 side conduits, and the first fluid flows though the hollow sliding sleeve directly into the second shunt tube 10 as fluid flow F1".

FIG. 3.B shows the valve arrangement 2 in a second configuration (activated configuration) after activation of the first dart catcher 22 by a first dart 27. In this configuration, the sliding sleeve 21 opens the side opening 24 and the dart closes one end of the sliding sleeve so that the flow of the first fluid F1 is mainly diverted through the side opening 24 into the first side conduit 25. Subsequently, the first fluid flow F1 splits as a third portion F1'" flowing into the reservoir conduit 3D and a first portion F1' flowing into the first shunt tube 9. The third portion F1'" flowing into the reservoir conduit 3D pressurizes the reservoir 3 by acting on the piston 3B (see FIG. 2).

The first portion F1' flowing into the first shunt tube 9 activates the dosing and mixing arrangement 4 as it will be further described herein below.

FIG. 3.C shows the valve arrangement 2 in an optional third configuration (by-pass configuration) after activation of the second dart catcher 23 by a second dart 28. In this configuration, the sliding sleeve 21 opens the second side conduit 26 and closes the side opening 24 so that the first fluid F1 is mainly diverted through the second side conduit 26. The first fluid flows directly into the second shunt tube 10 as fluid flow F1" which corresponds to a non-activated fluid chemically identical to the first fluid F1.

The first and second darts and the corresponding dart catchers are sized so that the first dart activates the first dart catcher and cannot activate the second dart catcher. The first and second darts of the above described embodiment are of spherical shape. However, it will appear obvious for a man skilled in the art that others kinds of shape are possible, and that others kinds of catcher (e.g. plug catcher) can also achieve the same remote activation function (e.g. see the application examples hereinafter).

FIGS. 4.A and 4.B schematically show the dosing and mixing arrangement 4 according to a first and a second embodiment respectively.

The dosing and mixing arrangement 4 comprises an engine part 31, a pumping part 32 and a gearing part 33.

The engine part 31 is coupled to the valve arrangement by the first shunt tube 9. The pumping part 32 is coupled to the reservoir by the second reservoir conduit 3E. When the valve arrangement is in the activated configuration, the flow of the first portion F1' of the first fluid activates the engine part 31. The engine part 31 produces a mechanical movement that activates the pumping part 32 through the gearing part 33 (schematically illustrated by the dotted lines). When activated, the pumping part 32 sucks the activation fluid FA from the reservoir (that may be pressurized by the third portion F1'" of the first fluid flow). The gearing part 33 allows selecting the volume ratio of the two flows, namely the activation fluid FA and the first portion F1' of the first fluid.

Advantageously, the engine part and the pumping part are progressive cavity or helical rotor type pumps. These types of pump are also known as Moineau pump and consists of a helical rotor which rotates inside a helical stator. The geometry and dimensions of the rotor and stator are designed so that a double string of sealed cavities are formed when the rotor turns into the stator. The cavities progress axially from the suction to the discharge port of the pump, thus carrying the fluid. The rotation rate of the rotor is proportional to the fluid flow rate.

Alternatively, the pumping part may also form a peristaltic pump, the pumping part being coupled to a simple flexible tube compressed and released by the movement of the pumping part run by the engine part.

According to the first embodiment shown in FIG. 4.A, the dosing and mixing arrangement 4 further comprises a complementary mixing arrangement 5.

The first portion F1' of the first fluid flows out of the engine part 31, while the activation fluid FA flows out of the pumping part 32.

The complementary mixing arrangement 5 comprises a flow splitter 34, a pre-mixing chamber 35 and a final-mixing chamber 36. The mixing arrangement insures a proper mixing of the first fluid flowing out of the engine part with the activation fluid FA flowing out of the pumping part.

The first portion F1' flows through the flow splitter 34. The flow splitter 34 is coupled to an inlet of the pre-mixing chamber 35 and to an inlet of the final-mixing chamber 36.

The pre-mixing chamber 35 is also coupled to the pumping part through an injecting conduit 37. It insures a first mixing of the split portion F1' of the first fluid with the activation fluid FA. For improving the mixing process, the injecting conduit may be a Venturi tube producing a jet of activation fluid in the pre-mixing chamber.

The final mixing chamber 36 is also coupled to outlet of the pre-mixing chamber. It insures a second mixing of the other split portion F1' of the first fluid with the pre-mixed fluid mixture. The outlet of the final mixing chamber delivers a second fluid flow F2, namely an activated fluid mixture.

The final mixing chamber outlet may include a float valve, preventing any back flow from the well-bore.

According to the second embodiment shown in FIG. 4.B, the engine part 31 is positioned downstream of the pumping part 32. The activation fluid flows FA into the engine part 31 by its superior part. Thus, the movement of the engine part insures a proper mixing of the fluid to be activated F1' with the activation fluid flow FA. In this embodiment, the complementary mixing arrangement is not necessary as mixing already occurred properly in the dosing and mixing arrangement 4.

Three different applications will be described hereinafter in relation with FIGS. 5, 6 and 7.

FIGS. 5.A, 5.B and 5.C relate to a first application of the invention corresponding to a cement plug located in a lost circulation zone (i.e. the activation fluid is used so that the fluid injected into the annulus can become thick enough, or the cement setting time can be shortened to limit losses). The injecting apparatus 101 is run at the bottom of the drill stem 106. It is activated by a dart 127 sent from the surface into the drill stem. The injecting apparatus 101 can be retrieved at the end of the injection operation.

FIGS. 5.B and 5.C shows a detailed cross-section view of the injecting apparatus 101 in a rest configuration and in an activated configuration respectively.

The injecting apparatus 101 comprises a valve arrangement 102, a reservoir 103 and a dosing and mixing arrangement 104. The injecting apparatus 101 is installed inside a standard casing or a special housing. The length of the injecting apparatus should be almost the same as a casing length.

The valve arrangement 102 comprises a mandrel 109 and a sliding sleeve 121.

The mandrel 109 is a tube having substantially the same diameter or less than the drill stem 106. It is coupled by a top part to the drill stem and receives through the inlet 107 the fluid flowing through the drill stem. It is coupled by a bottom part to at least one shunt tube 110. The bottom part also comprises an abutment 109A. The sliding sleeve 121 is guided within the mandrel.

The sliding sleeve 121 comprises a dart catcher 122, first 124 and second 124' openings and a top part 121A.

The valve arrangement can be in a rest configuration (FIG. 5.B) or in an activated configuration (FIG. 5.C).

In the rest configuration, the first openings 124 enable the fluid flowing into the mandrel to be diverted into the shunt tube 110. The sliding sleeve 121 can be maintained in the rest position by, for example, a pin mechanism 121B.

In the activated configuration, the second openings 124' enable the fluid flowing into the mandrel to be diverted into the dosing and mixing arrangement 104. The sliding sleeve 121 can be maintained in the activated configuration when, for example, the top part 121A is in contact with the abutment 109A.

The dart catcher 122 enables to activate the valve arrangement from the rest configuration to the activated configuration.

The reservoir 103 is an annular bladder. The annular bladder is installed around the mandrel 109.

The top extremity of the bladder comprises a filling hose 103B closed by a top plug 103A. The bottom extremity of the bladder comprises an evacuation hose closed by a bottom plug 103D. The extremities of these hoses are secured in the injecting apparatus near both extremities of the mandrel. The plugs can be removed to fill or flush the reservoir. The top plug 103A or the bottom plug 103D may be equipped with a relief valve for automatically venting the air trapped in the bladder.

The reservoir 103 is connected to the dosing and mixing arrangement 104 by a reservoir conduit 103E.

The pressure of the reservoir 103 is automatically adjusted to the pressure inside the drilling stem (hydrostatic pressure plus surface pressure) and/or in the mandrel by means of at least one equalization port 103C drilled in the mandrel 109. The equalization port 103C operates as follows: the fluid in the mandrel penetrates in the equalization port and exerts its pressure onto the reservoir, thus pressurizing the reservoir. When the reservoir is an annular bladder, it is deformed until the pressures outside and inside the reservoir are equilibrated.

The dosing and mixing arrangement 104 comprises an engine part 131 mechanically coupled to a pumping part 132. Advantageously, the engine part 131 is a progressive cavity or helical rotor type pump and the pumping part 132 is a peristaltic pump. The progressive cavity pump is coupled to the peristaltic pump by a driving shaft 133. The end of the reservoir conduit 103E is a flexible tube coupled to the peristaltic pump.

The engine part 131 namely the progressive cavity pump is driven by any fluid flowing through it. When a fluid flows through the engine part 131, it makes the pumping part 132 namely the peristaltic pump to rotate. The rotation of the peristaltic pump alternatively compresses and releases the flexible tube of the reservoir conduit 103E, thus sucking the activation fluid AF out of the reservoir.

The engine part 131 is positioned downstream of the pumping part 132 in order to ensure a better mixing of the fluid to be activated and the activation fluid.

The peristaltic pump is well adapted as long as the required activation fluid injection rate is a few percents of the main flow rate.

The activated fluid is injected into the well-bore through the outlet 108" downstream of the engine part 131.

The injecting apparatus 101 for the first application operates as follows.

In the rest configuration shown in FIG. 5.B, the injecting apparatus 101 can be used to deliver a non activated fluid F1" into the well-bore. The sliding sleeve 121 of the valve arrangement 102 is positioned into the mandrel 109 so that the fluid flowing into the mandrel is diverted through the first openings 124 into the shunt tube 110 towards the shunt tube outlet 108'.

In order to activate the valve arrangement, a dart 127 is launched from the surface and transported by the fluid that is to be activated.

In the activated configuration shown in FIG. 5.C, the injecting apparatus 101 is used to deliver an activated fluid F2 into the well-bore.

The dart catcher 122 of the sliding sleeve receives the dart transported by the fluid. The dart catcher 122 is for example a particular profile of the sliding sleeve (narrow area) for stopping and sealing the dart 127. When the dart lands in the dart catcher, the sliding sleeve acts as a plug and blocks the fluid flow. Consequently, the upstream pressure rises, thus creating a downward load that moves the sleeve in the activated configuration. When the sliding sleeve is maintained in the rest configuration by a pin mechanism, the downward load shears the pins 121B and releases the sliding sleeve. The sliding sleeve 121 slides downward in the mandrel and the top part 121 A of the sliding sleeve bumps into the abutment 109A of the mandrel.

In this configuration, the sliding sleeve 121 simultaneously closes the shunt tube 110 and diverts the flow through the second opening 124' towards the engine part 131. The engine part 131 begins to rotate and makes the pumping part 132 to rotate, thus sucking the activation fluid AF out of the reservoir 103.

The activation fluid flow FA and the fluid flow F1' to be activated mixes together downstream of the pumping part 132 (i.e. in the engine part 132). An activated fluid flow F2 is delivered in the annulus AN of the well-bore WB.

FIGS. 6.A, 6.B, 6.C relate to a second application corresponding to a casing cementation (i.e. the activation fluid is used so that the cement setting time can be shortened to save rig time). The injecting apparatus 201 is incorporated between the two casing elements CS1, CS2. It is activated by a dart 227 sent from the surface through the casing. The injecting apparatus 201 may be drilled out at the end of the cementing operation.

FIGS. 6.B and 6.C shows a detailed cross-section view of the injecting apparatus 201 in a rest configuration and in an activated configuration respectively.

The injecting apparatus 201 comprises a valve arrangement 202, a reservoir 203 and a dosing and mixing arrangement 204. The injecting apparatus 201 is installed inside two standard casings between casing element CS1 and CS2 by means of a nipple CSN. The casing element CS2 may be a casing shoe.

The valve arrangement 202 comprises a mandrel 209 and a sliding sleeve 221.

The mandrel 209 is a tube having an inferior diameter than the casing CS1, CS2 diameter. It receives the fluid flowing through the casing. Because of the significant difference between the casing internal diameter and the mandrel inside diameter, a double dart assembly DD is used for the activation operation. The mandrel 209 is coupled by a top part to a superior dart catcher 222C having a size substantially corresponding to the internal size of the casing. The superior dart catcher 222C is adapted to receive the double dart assembly DD transported by the fluid. The mandrel 209 is coupled by a bottom part to at least one shunt tube 210. The bottom part also comprises an abutment 209A. The sliding sleeve 221 is guided within the mandrel.

The sliding sleeve 221 comprises a inferior dart catcher 222A, first 224 and second 224' openings and a top part 221A.

The valve arrangement can be in a rest configuration (FIG. 6.B) or in an activated configuration (FIG. 6.C).

In the rest configuration, the first openings 224 enable the fluid flowing into the mandrel to be diverted into the shunt tube 210. The sliding sleeve 221 can be maintained in the rest configuration by, for example, a pin mechanism 221B.

In the activated configuration, the second openings 224' enable the fluid flowing into the mandrel to be diverted into the dosing and mixing arrangement 204. The sliding sleeve 221 can be maintained in the activated configuration when, for example, the top part 221A is in contact with the abutment 209A.

The inferior dart catcher 222A enables to activate the valve arrangement from the rest configuration to the activated configuration.

The reservoir 203 is an annular bladder 203. The annular bladder is installed around the mandrel 209.

The top extremity of the bladder comprises a filling hose 203B closed by a top plug 203A. The bottom extremity of the bladder comprises an evacuation hose closed by a bottom plug 203D. The extremities of these hoses are secured in the injecting apparatus near both extremities of the mandrel. The plugs can be removed to fill or flush the reservoir. The top plug 203A or the bottom plug 203D may be equipped with a relief valve for automatically venting the air trapped in the bladder.

The reservoir is connected to the dosing and mixing arrangement 204 by a reservoir conduit 203E.

The pressure of the reservoir 203 is automatically adjusted to the pressure inside the casing and/or in the mandrel by means of at least one equalization port 203C drilled in the mandrel 209. The equalization port 203C operates as follows: the fluid in the mandrel penetrates in the equalization port and exerts its pressure onto the reservoir, thus pressurizing the reservoir. When the reservoir is an annular bladder, it is deformed until the pressures outside and inside the reservoir are equilibrated.

The dosing and mixing arrangement 204 comprises an engine part 231 mechanically coupled to a pumping part 232. Advantageously, the engine part 231 is a progressive cavity or helical rotor type pump and the pumping part 232 is a peristaltic pump. The progressive cavity pump is coupled to the peristaltic pump by a driving shaft 233. The end of the reservoir conduit 203E is a flexible tube coupled to the peristaltic pump. The engine part 231 is driven by any fluid flowing through it. When a fluid flows through the engine part 231, it makes the pumping part 232 to rotate. The rotation of the peristaltic pump alternatively compresses and releases the flexible tube of the reservoir conduit 203E, thus sucking the activation fluid AF out of the reservoir 203. The engine part 231 is positioned downstream of the pumping part 232 in order to ensure a better mixing of the fluid to be activated and the activation fluid.

The activated fluid is injected into the well-bore through the outlet 208 downstream of the engine part 231 via for example a typical casing shoe CS2.

The injecting apparatus 201 for the second application operates as follows.

In the rest configuration shown in FIG. 6.B, the injecting apparatus 201 can be used to deliver a non activated fluid F1" into the well-bore. The sliding sleeve 221 of the valve arrangement 202 is positioned into the mandrel 209 so that the fluid flowing into the mandrel is diverted through the first openings 224 into the shunt tube 210 towards the outlet 208.

In order to activate the valve arrangement, a double dart assembly DD is launched from the surface and transported by the fluid that is to be activated.

In the activated configuration shown in FIG. 6.C, the injecting apparatus 201 is used to deliver an activated fluid F2 into the annulus AN of the well-bore WB.

The superior dart catcher 222C receives the double dart assembly DD transported by the fluid. When the double dart assembly DD lands in the superior dart catcher, the double dart assembly acts as a plug and blocks the fluid flow. Consequently, the upstream pressure rises, thus creating a downward load that liberates a small dart 227. The inferior dart catcher 222A receives the dart 227 transported by the fluid. The dart catcher 222A is for example a particular profile of the sliding sleeve (narrow area) for stopping and sealing the dart 227. Once again, when the dart lands in the dart catcher 222A, the sliding sleeve acts as a plug and blocks the fluid flow. Consequently, the upstream pressure rises, thus creating a downward load that moves the sleeve in the activated configuration. When the sliding sleeve is maintained in the rest configuration by a pin mechanism, the downward load shears the pins 221B and releases the sliding sleeve. The sliding sleeve 221 slides downward in the mandrel and the top part 221 A of the sliding sleeve bump into the abutment 209A of the mandrel.

In this configuration, the sliding sleeve 221 simultaneously closes the shunt tube 210 and diverts the flow through the second opening 224' towards the engine part 231. The engine part 231 begins to rotate and makes the pumping part 232 to rotate, thus sucking the activation fluid AF out of the reservoir 203.

The activation fluid flow FA and the fluid flow F1' to be activated mixes together downstream of the pumping part 232. An activated fluid flow F2 is delivered in the annulus AN of the well-bore WB.

As shown on the Figures, the double dart assembly may comprise an additional valve avoiding the activated fluid (e.g. cement) in the annulus of greater density than fluid (generally mud) within the casing to flow back to the surface in the casing.

FIGS. 7.A, 7.B, 7.C relate to a third application corresponding to a casing cementation in a casing-drilling configuration. The casing CS3 is already in place and the injecting apparatus 301 is pumped through the casing and lands above the casing shoe CS4. The injecting apparatus 301 is activated by a dart 327 sent from the surface through the casing. The injecting apparatus 301 may be drilled out at the end of the cementing operation.

FIGS. 7.B and 7.C shows a detailed cross-section view of the injecting apparatus 301 in a rest configuration and in an activated configuration respectively.

The injecting apparatus 301 comprises a valve arrangement 302, a reservoir 303 and a dosing and mixing arrangement 304.

The valve arrangement 302 comprises a mandrel 309 and a sliding sleeve 321.

The mandrel 309 is a tube having an inferior diameter than the casing CS3 diameter. It receives the fluid flowing through the casing via the inlet 307. Because of the significant difference between the casing internal diameter and the mandrel inside diameter, a double dart assembly DD' is used. The mandrel 309 is coupled by a top part to a superior dart catcher 322C having a size substantially corresponding to the internal size of the casing. The superior dart catcher 322C is adapted to receive the double dart assembly DD' transported by the fluid. The mandrel 309 is coupled by a bottom part to a shunt tube 310. The shunt tube comprises an abutment 309A under the bottom part of the mandrel. The sliding sleeve 321 is guided within the mandrel. The sliding sleeve 321 comprises an inferior dart catcher 322A.

The valve arrangement can be in a rest configuration (FIG. 7.B) or in an activated configuration (FIG. 7.C).

In the rest configuration, the fluid flowing into the mandrel flows through the sliding sleeve and is diverted into the shunt tube 310. The sliding sleeve 321 can be maintained in the rest configuration by, for example, a pin mechanism or sealing mechanism.

In the activated configuration, enable the fluid flowing into the mandrel is diverted through an opening 324 into the dosing and mixing arrangement 304. The sliding sleeve 321 is maintained in the activated configuration when it is in contact with the abutment 309A.

The inferior dart catcher 322A enables to activate the valve arrangement from the rest configuration to the activated configuration.

The reservoir 303 is an annular bladder, for example made in rubber material. The annular bladder is installed around the mandrel 309.

The top extremity of the bladder comprises a filling hose 303B closed by a top plug 303A. The bottom extremity of the bladder comprises an evacuation hose closed by a bottom plug 303D. The extremities of these hoses are secured in the injecting apparatus near both extremities of the mandrel. The plugs can be removed to fill or flush the reservoir. The top plug 303A or the bottom plug 303D may be equipped with a relief valve for automatically venting the air trapped in the bladder.

The reservoir is connected to the dosing and mixing arrangement 304 by a reservoir conduit 303E.

The pressure of the reservoir 303 is automatically adjusted to the pressure inside the casing and/or in the mandrel by means of at least one equalization port 303C drilled in the mandrel 309. The equalization port 303C operates as follows: the fluid in the mandrel penetrates in the equalization port and exerts its pressure onto the reservoir, thus pressurizing the reservoir. When the reservoir is an annular bladder, it is deformed until the pressures outside and inside the reservoir are equilibrated.

The dosing and mixing arrangement 304 comprises an engine part 331 mechanically coupled to a pumping part 332. Advantageously, the engine part 331 is a progressive cavity or helical rotor type pump and the pumping part 332 is a peristaltic pump. The progressive cavity pump is coupled to the peristaltic pump by a driving shaft 333. The end of the reservoir conduit 303E is a flexible tube coupled to the peristaltic pump. The engine part 331 is driven by any fluid flowing through it. When a fluid flows through the engine part 331, it makes the pumping part 332 to rotate. The rotation of the peristaltic pump alternatively compresses and releases the flexible tube of the reservoir conduit 303E, thus sucking the activation fluid AF out of the reservoir 303. The engine part 331 is positioned downstream of the pumping part 332 in order to ensure a better mixing of the fluid to be activated and the activation fluid. Thus the engine part 331 also acts as a mixing arrangement 305.

The activated fluid is injected into the well-bore through the outlet 308 downstream of the engine part 331 via for example a typical casing shoe CS4.

The injecting apparatus 301 for the third application operates as follows.

In the rest configuration shown in FIG. 7.B, the injecting apparatus 301 can be used to deliver a non activated fluid F1" into the well-bore. The sliding sleeve 321 of the valve arrangement 302 is positioned at the bottom of the mandrel 309 so that the fluid flowing into the mandrel flow through the sliding sleeve into the shunt tube 310 towards the outlet 308.

In order to activate the valve arrangement, a double dart assembly DD' is launched from the surface and transported by the fluid that is to be activated.

In the activated configuration shown in FIG. 7.C, the injecting apparatus 301 is used to deliver an activated fluid F2 into the annulus AN of the well-bore WB.

The superior dart catcher 322C receives the double dart assembly DD' transported by the fluid. When the double dart assembly DD' lands in the superior dart catcher, F the double dart assembly acts as a plug and blocks the fluid flow. Consequently, the upstream pressure rises, thus creating a downward load that liberates a small dart 327. The inferior dart catcher 322A receives the dart 327 transported by the fluid. The dart catcher 322A is for example a particular profile of the sliding sleeve (narrow area) for stopping and sealing the dart 327. Once again, when the dart lands in the dart catcher 322A, the sliding sleeve acts as a plug and blocks the fluid flow. Consequently, the upstream pressure rises, thus creating a downward load that moves the sleeve in the activated configuration. The sliding sleeve 221 slides downward and bumps into the abutment 309A.

In this configuration, the sliding sleeve 321 simultaneously closes the shunt tube 310 and diverts the flow through the opening 324 towards the engine part 331. The engine part 331 begins to rotate and makes the pumping part 332 to rotate, thus sucking the activation fluid AF out of the reservoir 303.

The activation fluid flow FA and the fluid flow F1' to be activated mixes together downstream of the pumping part 332. An activated fluid flow F2 is delivered in the annulus AN of the well-bore WB.

As shown on the Figures, the double dart assembly may comprise ah additional valve avoiding the activated fluid (e.g. cement) in the annulus of greater density than fluid (generally mud) within the casing to flow back to the surface in the casing.

It is to be noted that the peristaltic pump described in relation with the embodiments of FIGS. 5 to 7 may, alternatively, be equipped with several flexible tubes. In this case, the peristaltic pump may be designed to press simultaneously the several flexible tubes. Each tube may be fitted with a valve in order to adjust, for a given application, the activation fluid flow-rate to be injected in the fluid.

It is to be mentioned that the invention is not limited to onshore hydrocarbon well and can also be used in relation with offshore hydrocarbon well.

Also, a particular application of the invention relating to the oilfield industry has been described. However, the invention is also applicable to other kind of industry, e.g. the construction industry or the like.

The drawings and their description hereinbefore illustrate rather than limit the invention.

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. An injection apparatus for injecting an activated fluid into a well-bore, the apparatus comprising a reservoir for containing an activation fluid (AF), wherein the injection apparatus further comprises:

a valve arrangement adapted to be coupled to a pipe for receiving a first fluid (F1) flow, a dosing and mixing arrangement coupled to the reservoir and to the valve arrangement, and wherein:

the valve arrangement has a rest configuration in which the injection apparatus provides a non-activated fluid mixture (F1") and an activated configuration in which the injection apparatus provides an activated fluid mixture (F2), the dosing and mixing arrangement comprising an engine part mechanically coupled to a pumping part, the engine part running the pumping part and the pumping part sucking the activation fluid (AF) of the reservoir when the valve arrangement is in the activated configuration, and the dosing and mixing arrangement mixes the activation fluid (AF) with the first fluid and provides an activated fluid mixture flow (F2) at an outlet the valve arrangement is coupled to the outlet by a second shunt tube and the valve arrangement further has a by-pass configuration in which a second portion (F1") of the first fluid flows directly to the outlet, and wherein the activating steps are remotely controlled from a surface equipment.

2. An injection apparatus according to claim 1, wherein the injection apparatus further comprises a pressure adjusting arrangement for adjusting the pressure inside the reservoir to the pressure inside the pipe.

3. An injection apparatus according to claim 2, wherein the pressure adjusting arrangement comprises a piston fitted in the reservoir, said piston pressurizing the activation fluid (AF) of the reservoir when the valve arrangement coupled to the reservoir submits the piston to a third portion (F1'") of the first fluid.

4. An injection apparatus according to claim 2, wherein the pressure adjusting arrangement comprises a reservoir consisting of a bladder, said reservoir being coupled by at least one equalization port to a part of the injection apparatus submitted to the pressure inside the pipe.

5. An injection apparatus according to claim 4, wherein the part of the injection apparatus submitted to the pressure inside the pipe is the valve arrangement.

6. An injection apparatus according to claim 1, wherein the valve arrangement comprises a sliding sleeve having a first dart catcher for remotely activating the valve arrangement from the rest configuration to the activated configuration.

7. An injection apparatus according to claim 6, wherein the sliding sleeve has a second dart catcher for remotely activating the by-pass configuration of the valve arrangement.

8. An injection apparatus according to claim 1, wherein the engine part is coupled to the pumping part through a gearing part, the gearing part defining a volume ratio between the first portion (F1') of the first fluid and the activation fluid (AF).

9. An injection apparatus according to claim 8, wherein the gearing part is a driving shaft.

10. An injection apparatus according to claim 1, wherein the engine part is a progressive cavity pump.

11. An injection apparatus according to claim 1, wherein the pumping part is a progressive cavity pump.

12. An injection apparatus according to claim 1, wherein the pumping part is a peristaltic pump.

13. An injection apparatus according to claim 1, wherein the dosing and mixing arrangement further comprises a complementary mixing arrangement comprising:

a pre-mixing chamber coupled to the engine part and the pumping part, and a final mixing chamber coupled to the engine part and the pre-mixing chamber.

14. An injection apparatus for injecting an activated fluid mixture into a well-bore according to claim 13, wherein the pre-mixing chamber is coupled to the pumping part by a Venturi type injecting conduit.

* * * * *